72-225 SR
10/15/85 XR 4,546,527

United States Patent [19]

Fukuda et al.

[11] Patent Number: 4,546,527

[45] Date of Patent: Oct. 15, 1985

[54] COMPOSITE SLEEVE FOR USE IN ROLLING ROLLS FOR H-SECTION STEEL AND CHANNEL STEEL

[75] Inventors: Masahiro Fukuda, Itami; Akitoshi Okabayashi, Nishinomiya; Tadashi Narahara, Kobe; Kenji Muramatsu, Amagasaki; Noriyuki Miyazaki; Masanori Fukushima, both of Sakai, all of Japan

[73] Assignees: Kubota Ltd., Osaka; Nippon Steel Corporation, Tokyo, both of Japan

[21] Appl. No.: 445,270

[22] Filed: Nov. 29, 1982

[30] Foreign Application Priority Data

| | | | |
|---|---|---|---|
| Dec. 1, 1981 | [JP] | Japan | 56-193818 |
| Dec. 1, 1981 | [JP] | Japan | 56-193819 |
| Dec. 1, 1981 | [JP] | Japan | 56-193820 |
| Dec. 1, 1981 | [JP] | Japan | 56-193821 |
| Dec. 1, 1981 | [JP] | Japan | 56-193822 |
| Dec. 1, 1981 | [JP] | Japan | 56-193823 |

[51] Int. Cl.[4] ..... B21B 27/02

[52] U.S. Cl. ..... 29/132; 72/225; 29/130; 29/125

[58] Field of Search ..... 29/132, 124, 125, 130; 72/225, 366, 236

[56] References Cited

U.S. PATENT DOCUMENTS

| | | | |
|---|---|---|---|
| 1,996,500 | 4/1935 | Adams | 29/130 X |
| 2,030,891 | 2/1936 | Payne | 29/130 X |
| 3,855,015 | 12/1974 | Nemoto et al. | 29/130 X |
| 3,968,551 | 7/1976 | Miyashita | 29/132 |
| 4,064,608 | 12/1977 | Jaeger | 29/132 |
| 4,165,407 | 8/1979 | Endoh et al. | 29/132 |
| 4,165,628 | 8/1979 | Okada | 29/125 X |

FOREIGN PATENT DOCUMENTS

| | | | |
|---|---|---|---|
| 2415044 | 10/1974 | Fed. Rep. of Germany | 29/130 |
| 56012 | 5/1977 | Japan | 29/130 |
| 42114 | 4/1978 | Japan | 29/132 |
| 153659 | 11/1980 | Japan | 29/130 |
| 158250 | 12/1980 | Japan | 29/130 |

*Primary Examiner*—Howard N. Goldberg
*Assistant Examiner*—John T. Burtch
*Attorney, Agent, or Firm*—Oblon, Fisher, Spivak, McClelland & Maier

[57] ABSTRACT

A composite sleeve for use in a hot-rolling roll for H-section steel and channel steel comprises a working layer adapted to contact the material to be rolled and composed of two layers, i.e., a first outer layer made of one of adamite with graphite, spheroidal graphite cast iron and adamite having high resistance to sticking, and a second outer layer made of adamite or high chromium iron having high resistance to wear; and an inner layer adapted to be out of contact with the material and made of spheroidal graphite cast steel or spheroidal graphite cast iron having high toughness. The first outer layer covers the second outer layer, and the second outer layer covers the inner layer, the three layers of the first outer layer, the second outer layer and the inner layer being joined together by melting.

14 Claims, 16 Drawing Figures

COMPOSITE SLEEVE FOR USE IN ROLLING ROLLS FOR H-SECTION STEEL AND CHANNEL STEEL

BACKGROUND OF THE INVENTION

1. Technical Field

The present invention relates to sleeves for use in hot-rolling rolls, and more particularly to sleeves for use in rolling rolls for H-section steel, channel steel, etc., especially in sleeve rolls for the horizontal stands of universal mills.

2. Prior Art

Presently universal mills as shown in FIG. 2 are generally used for producing H-section steel shapes, etc. by rolling from the viewpoint of productivity and the quality of the product. Briefly stated, the universal mill comprises a pair of upper and lower horizontal rolls 1, 1 and a pair of vertical rolls 2, 2 arranged side by side. The material to be rolled into H-section steel, 3, is passed between the opposed rolls and thereby rolled from above and below and also widthwise at the same time.

With this arrangement, there is the need to alter the shape of the horizontal rolls 1, 1 in conformity with the shape of the product, so that sleeve rolls are usually used. FIG. 2 shows such a sleeve roll which comprises a roll arbor 4 and a separate sleeve 5 attached thereto by shrinkage fit. When the working layer of the roll is damaged or worn by rolling operation, the sleeve 5 only is machined or replaced by a new one for the reuse of the roll.

The sleeve 5 for use in such a rolling sleeve roll for H-section steel must have the following properties. The outer layer portion of the sleeve 5 to be in contact with the material 3, namely, the working layer thereof must be resistant to sticking, wear and cracks, while the inner portion of the sleeve to be out of contact with the material 3 being attached to the roll arbor 4 by shrinkage fit, namely, the inner layer must have toughness to withstand the stress due to the shrinkage fit and the stress under the load of rolling operation.

The inner and outer portions of the sleeve must have properties which are in conflict with each other, i.e. wear resistance required of the working layer and toughness required of the inner layer. Accordingly composite sleeves, such as the one shown in FIG. 2, have been widely used. The composite sleeve comprises two layers of different materials serving as its working layer and inner layer and fused together.

However, with sophisticated qualities required of rolled products in recent years, it has been recognized that the composite sleeve, even if used, is still unable to give satisfactory performance and durability to the sleeve roll because for forming H-section steel shapes having elongated flanges, the web forming portion of the working layer and the flange end forming portions of the same working layer need to have different properties.

Stated more specifically the heat of material 3 is liable to concentrate on the web forming portion 6. The portions as indicated at A is especially affected by the heat from both the web and the flange, and thus has the problem of being likely to stick to the material. On the other hand, the flange forming portions 7 of the sleeve 5 has small peripheral speed in comparison with the running speed of the rolling material, and therefore rubs and comes into slide contact with the flange portions of material 3 which have a relatively low temperature due to heat radiation. Since the flange portions of the material are hardened by a reduced temperature, the portions 7 of the sleeve 5 have the problem that remarkable wear occurs especially at illustrated portions B about 20 to 40 mm away from the flange ends.

When sticking resistance of the sleeve working layer is improved to refrain from sticking to the material at portions A, it is not satisfactory in wear resistance at portions B, whereas when wear resistance of the sleeve working layer is improved to refrain from wearing at portions B, it is liable to stick to the material at portions A. Thus the sleeve heretofore used has the problem which must possess the properties conflicting to each other, and there have not existed such a sleeve which is satisfactory in both properties of resistance to sticking at portions A and resistance to wear at portions B.

SUMMARY OF THE INVENTION

The invention provides a composite sleeve for use in rolling rolls which comprises a working layer and an inner layer and which is characterized in that the working layer is composed of two layers, i.e., a first outer layer of a material having high resistance to sticking and a second outer layer of a material having high resistance to wear, the inner layer being made of a material having high toughness, the first outer layer, the second outer layer and the inner layer being fused together in the form of a three-layer structure, the material of each of the three layers having a specific chemical compositions as will be described below in detail.

Whereas conventional composite sleeves of the type described comprise the two layers of working and inner layers, the working layer of the invention is composed of the two layers of first outer layer and second outer layer of different materials to provide a three-layer sleeve and is thereby adapted to have different properties at different portions thereof as required.

According to the present invention, the first outer layer having high resistance to sticking is made of a material selected from among an adamite with graphite, a spheroidal graphite cast iron and an adamite, the second outer layer having high resistance to wear is made of an adamite or a high chromium iron, and the inner layer having high toughness is made of a spheroidal graphite cast steel or a spheroidal graphite cast iron.

According to the invention, an intermediate layer can be interposed between the layers to provide a four- or five-layer sleeve structure including the intermediate layer or layers when desired to thermally join the layers with improved effectiveness.

DETAILED DESCRIPTION OF THE INVENTION

Figure 3:
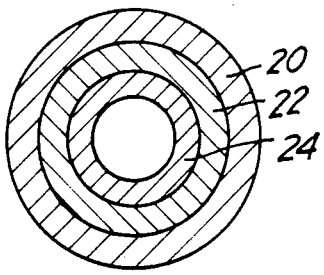
FIG. 3 is a sectional view showing an example of three-layer sleeve structure according to the invention.

FIG. 3 shows the embodiment of the structure of a three-layer sleeve of the invention.

Examples of useful materials for forming the first outer layer, the second outer layer and the inner layer of the three-layer sleeve of the invention are given below and will be described in detail.

FIRST OUTER LAYER (20)

The first outer layer having high resistance to sticking is prepared from one of (i) adamite with graphite, (ii) spheroidal graphite cast iron, and (iii) adamite. These materials will be described individually in detail. The percentages hereinafter used are all by weight.

(I) ADAMITE WITH GRAPHITE

Adamite with graphite useful for the first outer layer contains 2.0–3.2% C, 0.6–2.5% Si, 0.4–1.5% Mn, $0<Ni\leqq 2.5\%$, 0.5–2.0% Cr and $Cr<1.5Si\%$, 0.2–2.0% Mo, and up to 0.1% P, up to 0.1% S and other usually inevitable impurities, the balance being substantially Fe. In addition to the above components, one or at least two of Ti, Al and Zr can be incorporated into the adamite with graphite, in a combined amount of up to 0.1%.

The chemical components are limited as above for the following reasons.

C: 2.0–3.2%

At least 2.0% of C is incorporated into the material chiefly to give resistance to sticking. With less than 2.0% of C used, cementite and graphite are present in lesser amounts to result in reduced sticking resistance. However, if more than 3.2% of C is present, increased amounts of cementite and graphite present a problem in respect of resistance to cracks.

Si: 0.6–2.5%

Si crystallizes graphite and gives the matrix improved resistance to sticking. With less than 0.6% of Si present, graphite for improving the sticking resistance will not crystallize out, permitting the matrix to have impaired sticking resistance. When exceeding 2.5%, Si embrittles the matrix.

Mn: 0.4–1.5%

Mn eliminates the fault due to S, contributing to the increase of hardness and wear resistance. Use of less than 0.4% of Mn proves ineffective, whereas amounts exceeding 1.5% render the material brittle.

$0<Ni\leqq 2.5\%$

Ni gives enhanced hardness to the matrix but reduces the stability of the structure at high temperatures and results in lower resistance to surface deterioration, so that the Ni content should not exceed 2.5%.

Cr: 0.5–2.0% and $<1.5Si\%$

Cr improves the stability of cementite and the wear resistance of the matrix. With less than 0.5% of Cr present, a lesser amount of cementite and insufficient wear resistance will result. However, if Cr exceeds 2.0%, graphite will not crystallize, giving lower resistance to sticking. To permit stable crystallization of graphite despite an increase in the Cr content, Cr must fulfill the condition of $Cr<1.5Si\%$ in view of its relation with the Si content.

Mo: 0.2–2.0%

Mo, which gives increased hardness to the matrix, is not fully effective if used in an amount less than 0.2%. However, when more than 2.0% of Mo is present, a correspondingly increased effect will not result, hence economically disadvantageous.

Ti, Al and Zr, single or in combination: up to 0.1% in combined amount

Although the material is liable to become porous on casting, one or at least two of Ti, Al and Zr, if incorporated therein, give a flawless casting free of pores or voids. However, since these elements are all deoxidizers, an excess of such an element, if used, causes excessive oxidation, impeding the flow of the material in a molten state. Accordingly these elements are limited to a combined amount of up to 1.0%.

P: up to 0.1%

P increases the flowability of the melt and gives resistance to wear and to sticking but embrittles the material. The P content should therefore be up to 0.1%.

S: up to 0.1%

Like P, S embrittles the material and is accordingly limited to 0.1% if in the largest amount.

Inoculation is effective in rendering the structure finer and in promoting graphitization. Thus the present material can be made to have a finer structure with graphite uniformly distributed therein by inoculation. For this purpose, it is suitable to inoculate the material with 0.05 to 1.0% of Si because if the amount of Si is less than 0.05%, an inoculation effect will not be achieved, whereas if it is more than 1.0%, a correspondingly increased effect is unavailable. Examples of suitable inoculation agents are CaSi and FeSi. With the inoculation thus made, the combined Si content of the material is adjusted to the foregoing range of 0.6 to 2.5%.

Microscopically the structure of the present material comprises the three phases of cementite, graphite and matrix. Cementite, although effective for giving resistance to wear and sticking, impairs crack resistance if present in an excessive amount. Graphite affords resistance to sticking but results in reduced wear resistance if present excessively. When martensite is formed in the matrix, the structure exhibits lower stability at high temperatures and encounters problems during operation, so that the matrix is preferably adjusted to have a pearlite or bainite structure.

(II) SPHEROIDAL GRAPHITE CAST IRON

Spheroidal graphite cast iron useful for the first outer layer contains 2.8–3.8% C, 1.2–3.0% Si, 0.2–1.0% Mn, $0<Ni\leqq 3.0\%$, 0.1–1.0% Cr, 0.2–2.0% Mo, 0.02–0.1% Mg, and up to 0.1% P, up to 0.04% S and other usually inevitable impurities, the balance being substantially Fe. In addition to the above components, rare earth elements can be incorporated into the material in a combined amount of up to 0.05% when desired.

The chemical components are limited as above for the following reasons.

C: 2.8–3.8%

When the present material contains less than 2.8% of C, chilling is very likely to occur, presenting difficulties in the crystallization of graphite which is very effective for giving resistance to sticking and to cracks. With more than 3.8% of C present, on the other hand, excessive graphitization takes place, giving rise to problems in respect of strength.

Si: 1.2–3.0%

Si chiefly serves to control graphitization. When the amount of Si is less than 1.2%, chilling occurs markedly to reduce the amount of crystallization of graphite which is very effective for giving resistance to sticking and to cracks. However, if it is in excess of 3.0%, excessive graphitization occurs, and Si contained in ferrite in the form of a solid solution embrittles the material.

Mn: 0.2–1.0%

Mn combines with S to eliminate the adverse effect of S and, at the same time, readily serves to give improved hardness and enhanced wear resistance. These effects will not be produced sufficiently if the Mn content is less than 0.2%, whereas the material becomes brittle if it is present in excess of 1.0%.

$0<Ni\leqq 3.0\%$

Although useful for increasing the hardness of the matrix, Ni acts to reduce the stability of the structure at high temperatures and to impair the resistance to surface deterioration. Accordingly the present material should not contain more than 3.0% of Ni.

Cr: 0.1–1.0%

Cr is incorporated into the present material chiefly to reinforce cementite and to control the amount of cementite. With less than 0.1% of Cr present, a decreased amount of cementite will result, while the cementite will not be reinforced effectively. When the amount is more than 1.0%, however, an excess of cementite will be formed, reducing the amount of graphite which is useful for giving resistance to sticking.

Mo: 0.2–2.0%

Although Mo acts to afford higher hardness to the matrix, this effect will not be produced sufficiently if it is present in an amount of less than 0.2%. If the Mo content exceeds 2.0%, the above effect levels off, hence unfavorable from the viewpoint of economy. Chilling then occurs markedly.

Mg: 0.02–0.1%

Mg, which is used for spheroidizing the graphite, is not effective when present in an amount of less than 0.02%, whereas amounts exceeding 0.1% are objectionable because Mg acts to promote chilling and produces dross and defects in the casting.

Rare earth elements: up to 0.05%

In addition to the above components, up to 0.05% of rare earth elements can be incorporated into the spheroidal graphite cast iron material for forming the first outer layer when so desired. When used in a combined amount of up to 0.05%, these elements are effective for producing spheroidal graphite.

P: up to 0.1%

Although effective for increasing the flowability of the material in a molten state and for giving resistance to wear and to sticking, P embrittles the material and should therefore be limited to 0.1% if in the largest amount.

S: up to 0.04%

S inhibits spheroidization of graphite and therefore should be up to 0.04%.

As is the case with the adamite with graphite already described, inoculation is effective in rendering the structure finer and in promoting graphitization. Thus the present material can also be made to have a finer structure with graphite uniformly distributed therein by inoculation. It is suitable to inoculate the material with 0.05 to 1.0% of Si. Examples of suitable inoculation agents are CaSi and FeSi. The components concerned are so adjusted that the material thus inoculated contains 1.2 to 3.0% of Si.

Microscopically the structure of the present material comprises the three phases of cementite, graphite and matrix. Cementite, although effective for giving resistance to wear and sticking, impairs crack resistance if present in an excessive amount. Graphite affords resistance to sticking but results in reduced wear resistance if present excessively. When martensite is formed in the matrix, the structure exhibits lower stability at high temperatures and encounters problems during operation, so that the matrix is preferably adjusted to have a pearlite or bainite (preferably pearlite) structure.

(III) ADAMITE

Adamite materials generally have good crack resistance and high resistance to toughness and wear but exhibit a tendency to have inferior resistance to sticking. The sticking resistance, nevertheless, can be improved by increasing the amount of free cementite and also by suitably adjusting the proportions of the components, especially by reducing the Ni content.

Adamite useful for forming the first outer layer contains 2.2–3.0% C, 0.2–1.5 Si, 0.4–1.5% Mn, $0<Ni\leqq 2.5\%$, 0.5–4.0% Cr and $Cr\geqq 1.55Si\%$, 0.2–2.0% Mo, and up to 0.1% P, up to 0.1% S and other usually inevitable impurities.

In addition to the above components, one or at least two of Ti, Al and Zr in a combined amount of up to 0.1%, and/or one or both of up to 1.0% of Nb and up to 1.0% of V can be incorporated into the adamite when desired.

The chemical components are limited as above for the following reasons.

C: 2.2–3.0%

C determines the amount of free cementite which is effective for giving improved resistance to sticking. With less than 2.2% of C present, the amount of the carbides is smaller and will not improve the sticking resistance effectively, whereas when exceeding 3.0%, the C content greatly impairs the toughness and crack resistance.

Si: 0.2–1.5%

Si acts as a deoxidizer and also affords improved resistance to sticking but embrittles the material. With less than 0.2% of Si present, the material is prone to defects due to a gas even when centrifugal casting is resorted to, further exhibiting impaired resistance to sticking. When present in an amount of more than 1.5%, Si poses problems in respect of crack resistance.

Mn: 0.4–1.5%

Mn eliminates the adverse effects of S and serves to give improved hardness and higher resistance to wear. If contained in an amount of less than 0.4%, Mn proves ineffective, whereas amounts exceeding 1.5% result in a brittle material.

$0<Ni\leqq 2.5\%$

Ni increases the hardness of the matrix but impairs the stability of the structure at high temperatures, reducing the resistance to surface deterioration and also resulting in lower resistance to sticking. When the Ni content exceeds 2.5%, these drawbacks become pronounced, with the result that the first outer layer fails to serve the contemplated purpose. The Ni content must therefore be up to 2.5%.

Cr: 0.5–4.0% and $\geqq 1.5Si\%$

Cr is effective for reinforcing cementite and for giving improved wear resistance to the matrix. Below 0.5%, Cr fails to produce sufficient effects, whereas an excess of Cr permits cementite to readily precipitate in the form of a net to reduce the toughness of the material, so that the Cr content should be up to 4.0%. In order to obtain a structure of cementite only as contemplated without the crystallization of graphite even when Cr is used in a relatively small amount, the Cr content must fulfill the condition of $Cr \geqq 1.5Si\%$ in view of its relation to the Si content.

Mo: 0.2–2.0%

Although Mo acts to give enhanced hardness to the matrix, affording improved wear resistance, the effect of Mo is insufficient if the amount is less than 0.2%. However, even if the amount is above 2.0%, a correspondingly higher effect will not be produced, hence disadvantageous economically.

Single or conjoint use of Ti, Al and Zr: up to 0.1% in combined amount

Although the material is liable to become porous on casting, one or at least two of Ti, Al and Zr, if incorporated therein, give a flawless casting free from pores or voids. However, since these elements are all deoxidizers, an excess of such an element, if used, causes excessive oxidation, impeding the flow of the material in a molten state. Accordingly these elements are limited to a combined amount of up to 0.1%.

Nb and V: up to 1.0% each.

When desired, one or both of Nb and V are incorporated into the material. Nb is effective for making the structure of casting finer and also for giving improved crack resistance. These effects are remarkable when the element is used in an amount of up to 1.0%. Amounts above 1.0% will not produce any correspondingly increased effect. V is added for the same purpose as Nb. Up to 1.0% of V produces sufficient effects.

P: up to 0.1%.

P increases the fluidity of the melt and gives resistance to wear and to sticking but embrittles the material, so that the P content should be up to 0.1%.

S: up to 0.1%.

Like P, S embrittles the material. Accordingly the S content is up to 0.1%.

Microscopically the structure of the present material comprises the two phases of cementite and matrix. In view of resistance to sticking, it is desired that the matrix be composed chiefly of pearlite (with bainite or martensite minimized).

The web forming portion occupies the range of about 10 to about 50 mm from the upper surface of the first outer layer, while the flange forming portions are usually at a depth of about 100 mm from the upper surface of the first outer layer, so that the first outer layer has a thickness of about 20 to about 80 mm. The casting to provide the first outer layer is 30 to 130 mm in thickness since an allowable outer stock removal and the portion to be joined to the second outer layer by fusing should be considered.

SECOND OUTER LAYER (22)

The second outer layer having high wear resistance is made of (i) adamite, or (ii) high chromium iron. These materials will be described individually in detail. The percentages hereinafter used are all by weight.

(I) ADAMITE

Adamite used for the second outer layer contains 1.8–3.0% C, 0.2–1.5% Si, 0.4–1.5% Mn, 0.5–3.5% Ni, 0.5–6.0% Cr, 0.5–2.5% Mo, and up to 0.1% P, up to 0.1% S and other usually inevitable impurities, the balance being substantially Fe.

In addition to the above components, one or at least two of Ti, Al and Zr in a combined amount of up to 0.1%, and/or one or both of up to 1.0% of Nb and up to 1.0% of V can be incorporated into the adamite when desired.

The chemical components are limited as above for the following reasons.

C: 1.8–3.0%

At least 1.8% of C is incorporated into the material chiefly to give resistance to wear. With less than 1.8% of C contained, cementite will be present in a lesser amount to result in reduced wear resistance. However, if more than 3.0% of C is present, the material is brittle and is not usuable as contemplated.

Si: 0.2–1.5%

Si used for the present material is intended chiefly for deoxidation. With less than 0.2% of Si present, the effect will not be sufficient, whereas amounts above 1.5% embrittle the material.

Mn: 0.4–1.5%

Mn eliminates the adverse effects of S, serving to give improved hardness and higher resistance to wear. If present in an amount of below 0.4%, Mn proves ineffective, whereas amounts exceeding 1.5% render the material brittle.

Ni: 0.5–3.5%

To improve the hardness of the matrix for improved wear resistance, at least 0.5% of Ni is used. However, the Ni content, if excessive, permits formation of thermally instable martensite, entailing reduced resistance to surface deterioration. The upper limit for Ni is therefore 3.5%.

Cr: 0.5–6.0%

Cr stabilizes cementite, increases the volume of cementite as contained therein, and hardens and strengthens cementite, giving improved wear resistance. The Cr content fails to produce sufficient effects if less than 0.5% and embittles the material if more than 6.0%.

Mo: 0.5–2.5%

Mo, which increases the hardness of the matrix, must be contained in the material for the second outer layer in an amount of at least 0.5%. However, even if the Mo content is above 2.5%, a correspondingly enhanced effect will not be obtained, hence disadvantageous economically. Single or conjoint use of Ti, Al and Zr: up to 0.1% in combined amount.

When incorporating one or at least two of these elements, the material can be cast free of any pores or voids and is therefore serviceable more satisfactorily. Since these elements are all deoxidizers, an excess of such an element, if used, causes excessive oxidation, hindering the flow of the material in a molten state. Accordingly the elements are limited to a combined amount of up to 0.1%.

Nb and V: up to 1.0% each.

When desired, one or both of Nb and V are incorporated into the material. Nb is effective for making the structure of casting finer and also for giving improved wear resistance. For this purpose, Nb proves fully effective when used in an amount of up to 1.0%. V, which is used for the same purpose as Nb, produces a sufficient effect when present in an amount of up to 1.0%. When Nb or V is in excess of 1.0%, an increased amount of V or Nb carbide will result to render the material brittle.

P: up to 0.1%.

P increases the fluidity of the melt and gives resistance to wear and to sticking but embrittles the material, so that the P content should be up to 0.1%.

S: up to 0.1%.

Like P, S embrittles the material and therefore should not be in excess of 0.1%.

Microscopically the structure of the present material comprises the two phases of cementite and matrix. The matrix usually comprises pearlite. In accordance with the resistance to wear required, bainite or martensite can be contained therein partially.

(II) HIGH CHROMIUM IRON

High chromium iron useful for forming the second outer layer contains 2.0–3.2% C, 0.3–1.5% Si, 0.4–1.5% Mn, 0.5–3.5% Ni, 8.0–25.0% Cr, 0.5–2.5% Mo, and up to 0.1% P, up to 0.1% S and other usually inevitable impurities, the balance being substantially Fe.

In addition to the above components, one or at least two of Ti, Al and Zr in a combined amount of up to 0.1%, and/or one or both of up to 1.0% of Nb and up to 1.0% of V can be incorporated into the high chromium iron when desired.

C: 2.0–3.2%.

C must be in balance with Cr within the range wherein $(FeCr)_7C_3$ type carbides can be stabilized. With less than 2.0% of C present, a lesser amount of carbide will result, failing to afford the desired wear resistance. When the C content is above 3.2%, an excess of carbide will be formed, posing problems in respect of toughness.

Si: 0.3–1.5%.

Si, which is used mainly for deoxidation, is not very effective if in an amount of less than 0.3%. If it is in excess of 1.5%, Si contained in ferrite in the form of a solid solution embrittles the material.

Mn: 0.4–1.5%.

Mn, which is used for assisting in deoxidation and inhibiting the adverse effect of S, is not very effective if in an amount of less than 0.4%, whereas amounts above 1.5% result in reduced toughness.

Ni: 0.5–3.5%.

Ni acts to increase the hardenability and hardness of the matrix. To assure improved wear resistance, the Ni content should be at least 0.5%, whereas if exceeding 3.5%, Ni impairs the stability of the matrix at high temperatures to give reduced resistance to surface deterioration.

Cr: 8.0–25.0%.

Cr forms carbides and improves the hardenability of the matrix. When the Cr content is below 8.0%, increased amounts of $M_3C$ type carbides will be formed in place of uniformly distributed fine carbides, leading to reduced toughness. When it is above 25.0%, increased amounts of $M_{23}C_6$ type carbides formed result in insufficient wear resistance.

Mo: 0.5–2.5%.

Mo enhances the hardenability of the matrix and affords improved stability at high temperatures. When the Mo content is below 0.5%, such effects will not be produced sufficiently, whereas even if it is over 2.5%, the effects achieved level off.

Single or conjoint use of Ti, Al and Zr: up to 0.1% in combined amount.

When one or at least two of these elements are incorporated in the material, the material can be cast free from any pores or voids, providing a casting of sounder quality. Since these elements are all strong deoxidizers, an excess of such an element, if used, causes excessive oxidation, hindering the flow of the material in a molten state. Accordingly the elements are limited to a combined amount of up to 0.1%.

Nb and V: up to 1.0% each.

When desired, one or both of Nb and V are incorporated into the material. Nb is effective for forming a fine casting structure and promotes precipitation hardening to give improved wear resistance. These effects can be obtained sufficiently if Nb is used in an amount of up to 1.0%. V, which is used for the same purpose as Nb, is contained similarly in an amount of up to 1.0%. When more than 1.0% of V is present, increased amounts of carbides will result to embrittle the material.

P: up to 0.1%.

P increases the flowability of the melt and gives resistance to wear and to sticking but embrittles the material, so that the P content should be up to 0.1%.

S: up to 0.1%.

S, like P, embrittles the material and therefore should not exceed 0.1%.

Microscopically the structure of the present material is composed of carbides which are predominantly of the $(FeCr)_7C_3$ type. In accordance with the properties (wear resistance) required of the matrix, the matrix can be of pearlite or bainite or martensite within the foregoing ranges of the composition. Residual austenite may be present partly in the matrix.

The thickness of the working layer of the present sleeve is usually 100 to 250 mm even if inclusive of the flange width. Exclusive of the thickness of the first outer layer (20 to 80 mm), the thickness of the second outer layer is 20 to 230 mm.

With consideration given to the fusion layers (of intermediate chemical compositions) adjoining the first outer layer and the inner layer, the second outer layer must be cast with a thickness of 30 to 240 mm.

INNER LAYER (24)

Figure 1:
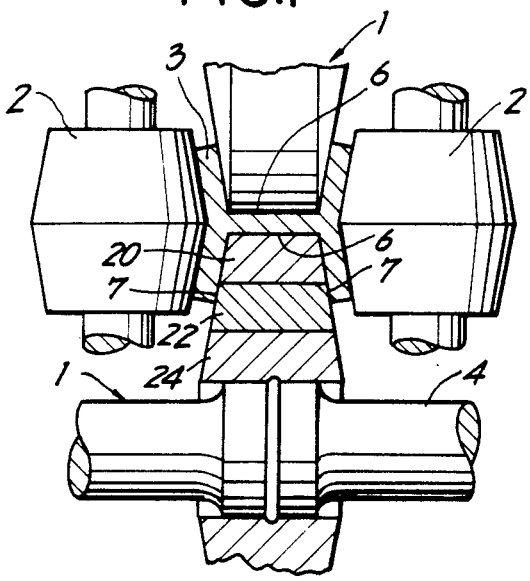
FIG. 1 is a fragmentary front view in section showing H-section steel being rolled by a universal mill including sleeve rolls of the invention.

When the present sleeve is assembled into a sleeve roll as seen in FIG. 1 for use, cracks that would develop from inside pose the most serious problem. For this reason, there is the need to form the inner layer from a tough material. There are two materials which fulfill this requirement, i.e., (i) spheroidal graphite cast steel, and (ii) spheroidal graphite cast iron, one of which is selected for use. These materials will be described below in detail individually. The percentages given below are all by weight.

(I) SPHEROIDAL GRAPHITE CAST STEEL

Spheroidal graphite cast steel useful for forming the inner layer contains 1.0–2.0% C, 0.6–3.0% Si, 0.2–1.0% Mn, 0.1–2.0% Ni, 0.1–3.0% Cr, 0.1–1.0% Mo, and up to 0.1% P, up to 0.1% S and other usually inevitable impurities, the balance being substantially Fe. In addition to the above components, one or at least two of Ti, Al and Zr can be incorporated into the cast steel in a combined amount of up to 0.1% when desired.

The chemical components are limited as above for the following reasons.

C: 1.0–2.0%.

C is present in the matrix in the form of a solid solution and appears therein as graphite (or partly becomes free cementite). When containing less than 1.0% of C, the material requires a higher temperature for melting and casting, giving rise to an increase in cost, while when the C content exceeds 2.0%, there is the likelihood that the graphite will not be spheroidal, leading to reduced toughness.

Si: 0.6–3.0%.

Si has a close relation to the crystallization of graphite. With less than 0.6% of Si present, it is substantially difficult to cause graphite to crystallize, whereas with more than 3.0% of Si present, the Si contained in the matrix in the form of a solid solution has a marked tendency to impair the toughness of the material.

Mn: 0.2–1.0%.

Mn combines with S to effectively eliminate the adverse effect of S. Mn fails to produce this effect when present in an amount of less than 0.2%, while the material has lower toughness when containing more than 1.0% of Mn.

Ni: 0.1–2.0%.

Ni retards the transformation of the material and is effective for improving the toughness thereof. This effect is insufficient when the Ni content is below 0.1%, while the Ni content need not exceed 2.0%.

Cr: 0.1–3.0%.

Cr is effective in affording toughness and stabilizing cementite. The Cr content should be at least 0.1% to assure toughness. However, an excess of Cr results in chilling and brittleness. Preferably the Cr content is lower because the Cr in the inner layer becomes mingled with that in the second outer layer to result in a higher content. The upper limit content is 3.0% to permit crystallization of graphite.

Mo: 0.1–1.0%.

Like Ni, Mo is an important element for assuring toughness. Mo fails to produce this effect when in an amount of less than 0.1% but renders the material harder and brittle when the amount exceeds 1.0%.

Single or conjoint use of Ti, Al and Zr: up to 0.1% in combined amount.

When one or at least two of these elements are incorporated in the material, the material can be cast free from any pores or voids, providing a casting of sounder quality. Since these elements are all strong deoxidizers, an excess of such an element, if used, causes excessive oxidation, hindering the flow of the material in a molten state. Accordingly the element are limited to a combined amount of up to 0.1%.

P: up to 0.1%.

P increases the flowability of the material in a molten state but embrittles the material, hence up to 0.1%.

S: up to 0.1%.

Like P, S embrittles the material, hence up to 0.1%.

It is known that inoculation is generally useful for effecting promoted graphitization. The toughness of the present material can be improved effectively by inoculating 0.1 to 1%, calculated as Si, of an agent such as CaSi, FeSi or the like into the material immediately before casting. The inoculation will not be effective if the amount is less than 0.1%, but the amount need not exceed 1.0%. The inoculation proves especially effective at higher Cr contents. The material thus inoculated is adjusted to contain 0.6 to 3.0% of Si as already specified.

Microscopically the structure of the present material is composed of the two phases of graphite and matrix and may contain a small amount of free cementite. The matrix consists predominantly of pearlite. The material is spheroidal graphite cast steel.

(II) SPHEROIDAL GRAPHITE CAST IRON

Spheroidal graphite cast iron useful for forming the inner layer contains 2.8–3.8% C, 1.5–3.2% Si, 0.3–1.0% Mn, $0<Ni\leqq 2.0\%$, $0<Cr\leqq 3.0\%$, $0<Mo\leqq 0.6\%$, 0.02–0.1% Mg, and up to 0.1% P, up to 0.03% S and other usually inevitable impurities, the balance being substantially Fe. In addition to the above components, rare earth elements may be incorporated into the spheroidal graphite cast iron in a combined amount of up to 0.05% when desired.

The chemical components are limited as above for the reasons given below.

C: 2.8–3.8%.

With less than 2.8% of C present, the material undergoes chilling and exhibits reduced toughness, while with more than 3.8% of C present, excessive graphitization occurs to entail insufficient strength.

Si: 1.5–3.2%.

While Si is used chiefly for controlling graphitization, insufficient graphitization will result if the Si content is below 1.5%. When the content exceeds 3.2%, excessive graphitization takes place, and the Si contained in ferrite in the form of a solid solution embrittles the material.

Mn: 0.3–1.0%.

Mn usually combines with S to eliminate the adverse effect of S and is therefore useful, but if the content is below 0.3%, no effect will result. When it is over 1.0%, the material becomes hard and brittle.

$0<Ni\leqq 2.0\%$.

Ni is effective for graphitization and for reinforcing the matrix, but if the amount exceeds 2.0%, these effects level off, so that the upper limit content is 2.0% in view of economy.

$0<Cr\leqq 3.0\%$.

Cr, which acts to stabilize cementite, permits chilling of the material and renders the material brittle when present in an amount of over 3.0%.

$0<Mo\leqq 0.6\%$.

Mo reinforces the matrix. When the amount is over 0.6%, this effect levels off, with a marked tendency for the material to become harder, hence up to 0.6%. Mg: 0.02–0.1%.

Mg is used for spheroidizing graphite but fails to produce this effect when in an amount of below 0.02%. Use of more than 0.1% of Mg causes chilling and is liable to produce dross and defects in the casting, hence objectionable.

Rare earth elements: up to 0.05%.

In addition to the above components, rare earth elements can be incorporated into the spheroidal graphite cast iron for forming the inner layer when desired. Such elements are effective for spheroidizing graphite when used in a combined amount of up to 0.05%.

P: up to 0.1%.

P increases the flowability of the material in a molten state but embrittles the material, hence up to 0.1%.

S: up to 0.03%.

The S content must be low to assure spheroidization of graphite and is therefore up to 0.03%.

It is known that inoculation is generally useful for effecting promoted graphitization and for rendering the structure finer. The toughness of the present material can be improved effectively by inoculating up to 1.0%, calculated as Si, of an inoculant such as CaSi, FeSi or the like into the material immediately before casting. The inoculation will not produce a further enhanced effect even if the amount exceeds 1.0%. The material thus inoculated is adjusted to contain 1.5 to 3.2% of Si as already specified.

Microscopically the structure of the spheroidal graphite cast iron useful for the inner layer is composed of the three phases of spheroidal graphite, a small amount of free cementite and matrix.

The materials given above are selectively used for the first outer layer, the second outer layer and the inner layer, and the three layers of different materials are joined together by melting to obtain a three-layer composite sleeve of the present invention. In order to assure the toughness of the material and to adjust or improve the hardness and wear resistance, the casting obtained for forming the three-layer sleeve of the invention is usually subjected to a heat treatment at an elevated temperature in the austenite range and to a heat treatment at a temperature of up to the eutectoid transformation temperature for the attendant tempering, isothermal transformation and strain relief.

Figure 5:
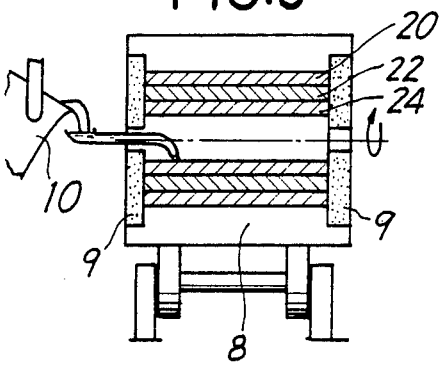
FIGS. 5 and 6 are sectional views showing processes for producing the three-layer sleeve of the invention.
Figure 6:
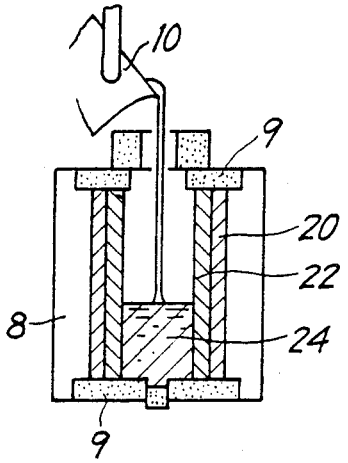

The three-layer sleeve of the present invention is prepared by the method to be described below briefly. The three-layer sleeve can be produced easily by resorting to the centrifugal casting process (with use of a horizontal, upright or inclined mold). As seen in FIG. 5, for example, the process uses a mold comprising a rotary mold member 8 having opposite ends lined with sand or refractory bricks 9. Molten materials for the first outer layer 20, the second outer layer 22 and the inner layer 24 are poured from a ladle 10 into the mold in succession with suitable timing, whereby a sleeve is obtained as contemplated in which the three layers are metallurgically joined together. It is also possible to cast the melt for the inner layer by a stationary method as shown in FIG. 6, wherein the melt is poured into a mold positioned upright and having the first and second outer layers already cast therein. (In this case, the core portion of the casting obtained must be machined to form a bore.)

With the three-layer sleeve thus prepared, the first outer layer, the second outer layer and the inner layer are metallurgically joined to one another by melting into an integral body. At the boundaries between the adjacent layers, mixed layers of the adjoining materials are inevitably formed.

With reference to FIG. 1 showing a three-layer sleeve of the invention, the heat of the material 3 to be rolled will concentrate on the web forming portion 6 of the sleeve 5, but this portion is not prone to sticking, while the flange forming portions 7 of the sleeve 5 are less susceptible to wear although in sliding contact with the flange end portions of the material 3 which have a relatively low temperature.

Figure 4A:
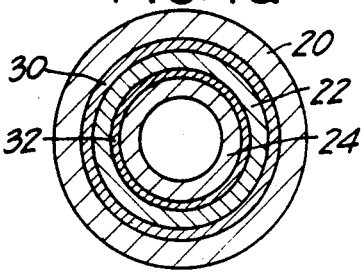
FIG. 4*a* is a sectional view showing an example of five-layer sleeve structure according to the invention.
Figure 4B:
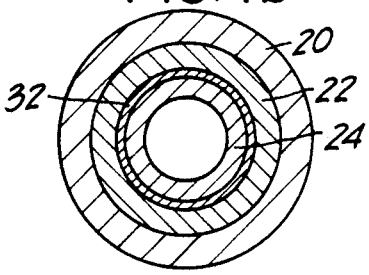
FIGS. 4*b* and 4*c* are sectional views showing an example of four-layer sleeve structure according to the invention.
Figure 2:
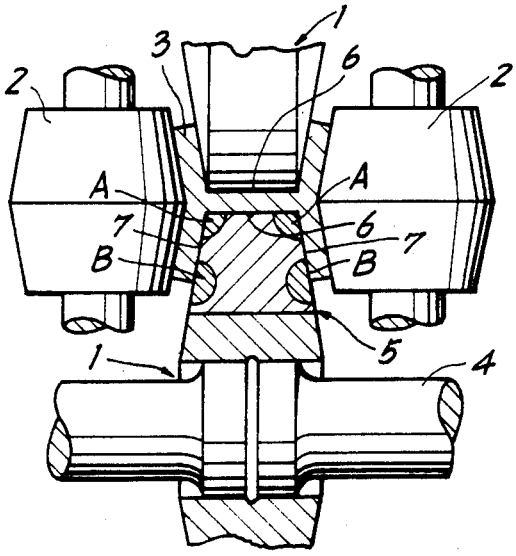
FIG.2 PRIOR ART
FIG. 2 is a fragmentary front view in section showing H-section steel being rolled by a universal mill including conventional sleeve rolls.
Figure 4C:
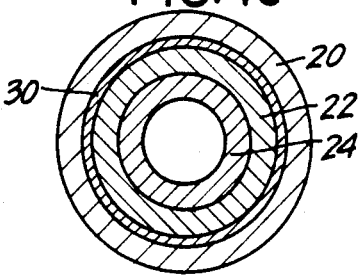

Incidentally the three-layer sleeve of the present invention is still likely to involve problems in respect of fusion of the adjacent layers at the boundary and penetration of alloy elements of one layer into another layer when the sleeve is actually produced. To produce a sleeve of more satisfactory performance free of such problems, it is also preferable to interpose an intermediate layer between the adjacent layers as desired. When intermediate layers 30, 32 are provided between the layers as illustrated in FIG. 4*a*, the sleeve has a maximum number of, i.e., five layers. The presence or absence, as well as the location, of the intermediate layer or layers should be determined from an overall viewpoint with consideration given to various factors such as economy. FIG. 4*b* shows an embodiment of the four-layer sleeve in which the second intermediate layer 32 is interposed between the second outer layer 22 and the inner layer 24. FIG. 4*c* shows an embodiment of the four-layer sleeve in which the first intermediate layer 30 is interposed between the first outer layer 20 and the second outer layer 22.

In the case of the sleeve of the present invention, it is generally advantageous to provide the second intermediate layer 32 between the second outer layer 22 and the inner layer 24.

Specific examples embodying the invention will be described below. The materials listed in Table 1 were used for the first outer layer, the second outer layer and the inner layer to prepare three-layer sleeves, 1060 mm in outside diameter, which were heat-treated as specified. The material listed in Table 2 was used for the first outer layer, the second outer layer, the second intermediate layer and the inner layer to prepare a four-layer sleeve having the same outside diameter as above. In each of the examples, the hardness distribution of the sleeve was measured radially of the sleeve with use of a Shore hardness tester. FIGS. 7 to 14 show the measurements.

Furthermore the sleeves of Example Nos. 3, 5, 7, 9, 11 and 13 were tested for residual stress by affixing a gauge to the sleeve tangentially of each layer and thereafter cutting the sleeve radially thereof. The measurement was determined from the difference between the stress values measured before and after the cutting. The results are given in Table 3, in which the minus sign indicates a compressive residual stress, and the plus sign a tensile residual stress.

Figure 7:
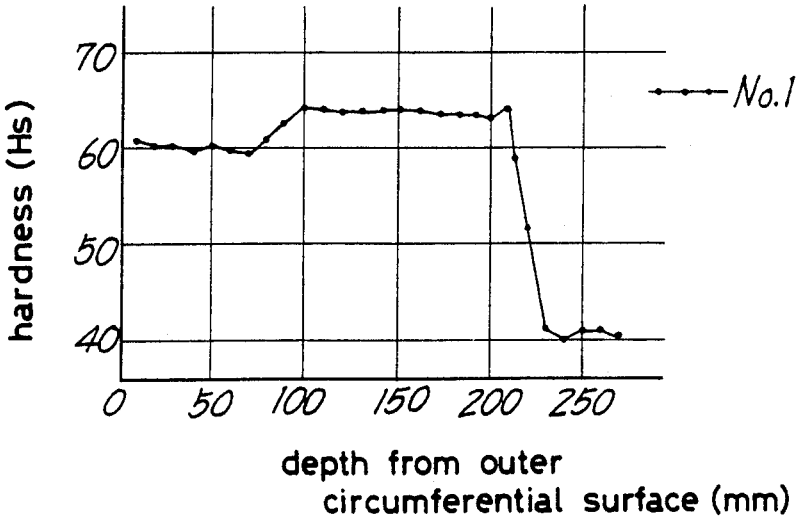
FIGS. 7 to 13 are diagrams showing the hardness distributions, each in radial section, of embodiments of three-layer sleeve of the invention.

Example No. 1: Adamite with graphite was used for the first outer layer, adamite for the second outer layer, and spheroidal graphite cast steel for the inner layer. The hardness distribution is shown in FIG. 7.

Figure 8:
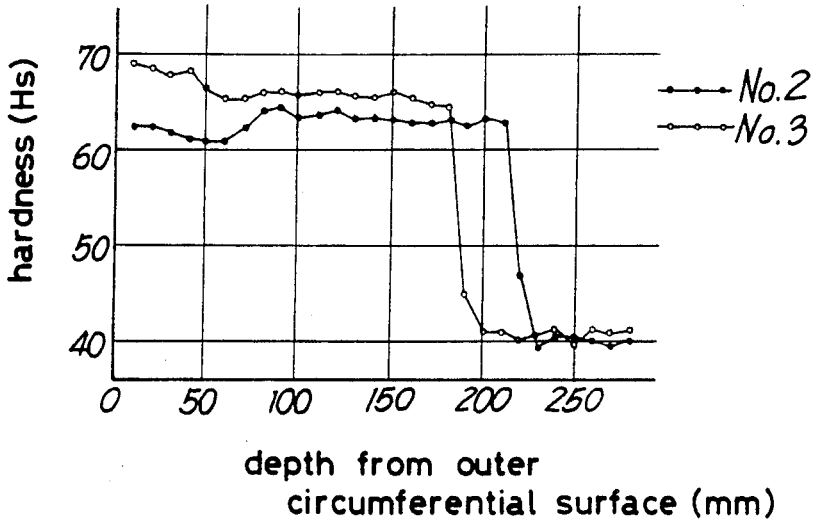

Example No. 2: Adamite with graphite was used for the first outer layer, adamite for the second outer layer, and spheroidal graphite cast iron for the inner layer. The hardness distribution is shown in FIG. 8.

Example No. 3: The same as Example No. 2.

Figure 9:
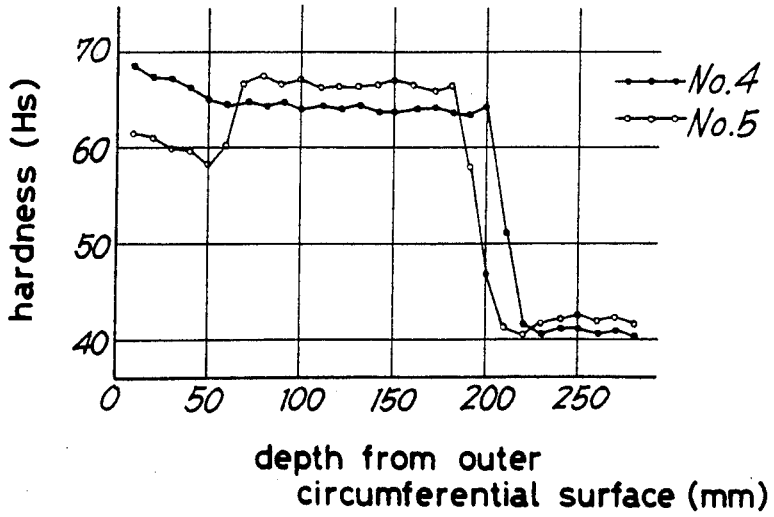

Example No. 4: Spheroidal graphite cast iron was used for the first outer layer, adamite for the second outer layer, and spheroidal graphite cast iron for the inner layer. The hardness distribution is shown in FIG. 9.

Example No. 5: Spheroidal graphite cast iron was used for the first outer layer, adamite for the second outer layer, and spheroidal graphite cast steel for the inner layer. The hardness distribution is shown in FIG. 9.

Figure 10:
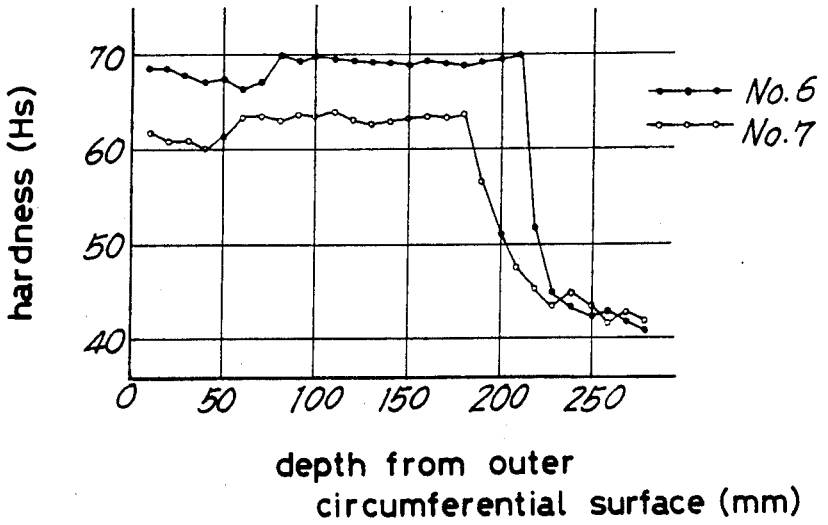

Example No. 6: Spheroidal graphite cast iron was used for the first outer layer, high chromium iron for the second outer layer, and spheroidal graphite cast steel for the inner layer. The hardness distribution is shown in FIG. 10.

Example No. 7: Spheroidal graphite cast iron was used for the first outer layer, high chromium iron for the second outer layer, and spheroidal graphite cast iron for the inner layer. The hardness distribution is shown in FIG. 10.

Figure 11:
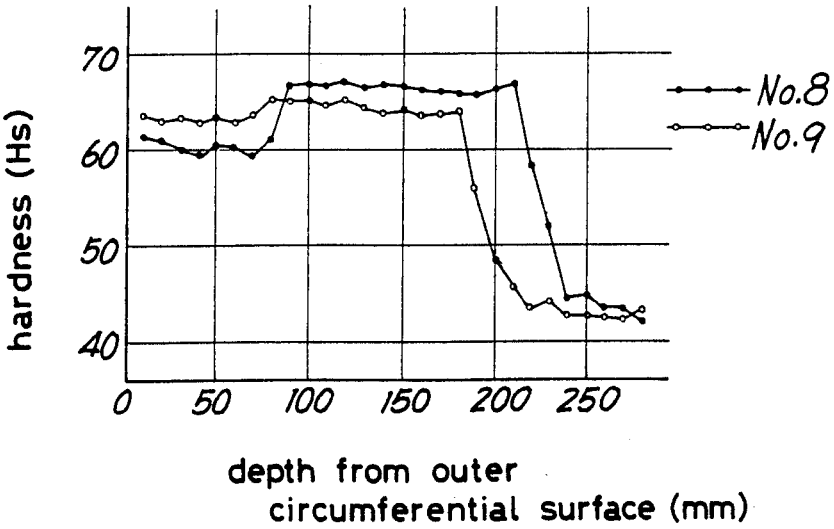

Example No. 8: Adamite with graphite was used for the first outer layer, high chromium iron for the second outer layer, and spheroidal graphite cast steel for the inner layer. The hardness distribution is shown in FIG. 11.

Example No. 9: Adamite with graphite was used for the first outer layer, high chromium iron for the second outer layer, and spheroidal graphite cast iron for the inner layer. The hardness distribution is shown in FIG. 11.

Figure 12:
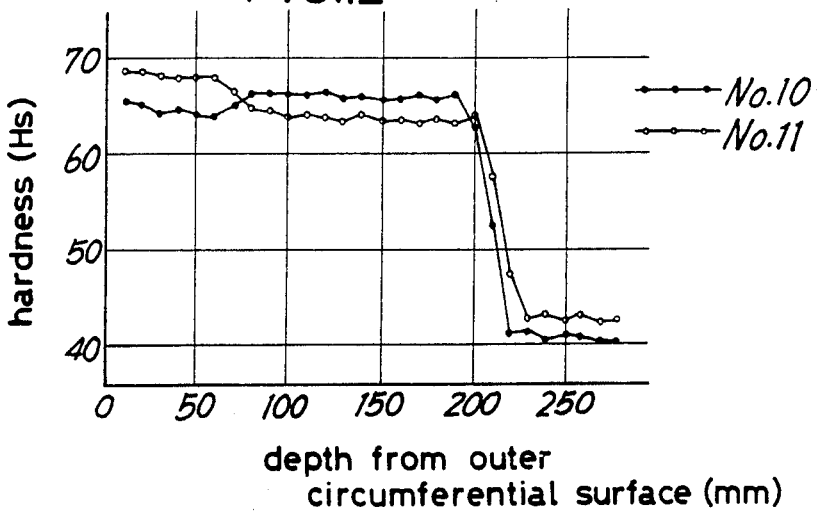

Example No. 10: Adamite was used for the first outer layer, Adamite was used for the second outer layer, and spheroidal graphite cast iron for the inner layer. The hardness distribution is shown in FIG. 12.

Example No. 11: Adamite was used for the first outer layer, adamite for the second outer layer, and spheroidal graphite cast steel for the inner layer. The hardness distribution is shown in FIG. 12.

Figure 13:
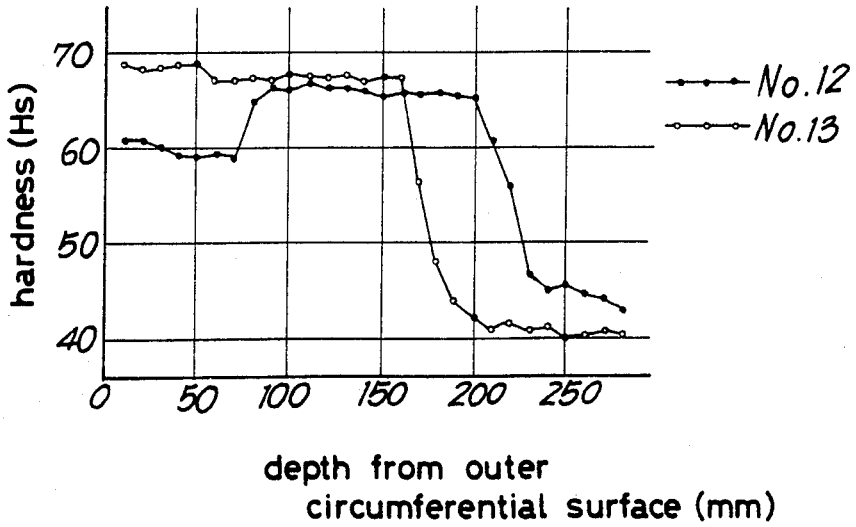

Example No. 12: Adamite was used for the first outer layer, high chromium iron for the second outer layer, and spheroidal graphite cast steel for the inner layer. The hardness distribution is shown in FIG. 13.

Example No. 13: Adamite was used for the first outer layer, high chromium iron for the second outer layer, and spheroidal graphite cast iron for the inner layer. The hardness distribution is shown in FIG. 13.

Figure 14:
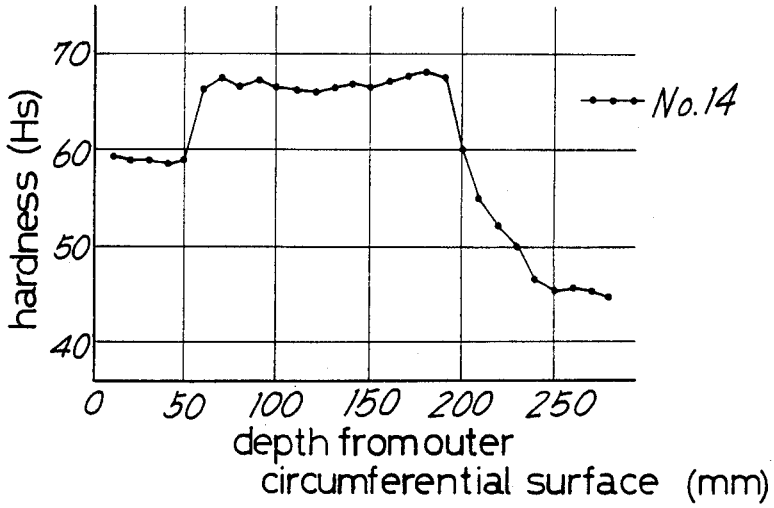
FIG. 14 is a diagram showing the hardness distributions in radial section of an embodiment of four-layer sleeve of the invention.

Example No. 14: Adamite with graphite was used for the first outer layer, high chromium iron for the second outer layer, and spheroidal graphite cast steel for the inner layer. Iron as shown in Table 2 was further used for the second intermediate layer. The hardness distribution is shown in FIG. 14.

TABLE 1

| No | | Thickness (mm) | Chemical composition (% by weight) C | Si | Mn | P | S | Ni | Cr | Mo | Mg | Al | Zr | Nb | V |
|---|---|---|---|---|---|---|---|---|---|---|---|---|---|---|---|
| 1 | First outer layer | 80 | 2.82 | 1.02 | 0.83 | 0.012 | 0.016 | 0.38 | 1.01 | 0.73 | — | — | — | — | — |
| | Second outer layer | 130 | 2.38 | 0.71 | 0.97 | 0.038 | 0.031 | 1.92 | 2.38 | 0.91 | — | — | — | — | — |
| | Inner layer | 80 | 1.55 | 1.62 | 0.58 | 0.021 | 0.009 | 0.62 | 0.41 | 0.28 | — | — | — | — | — |
| 2 | First outer layer | 60 | 2.12 | 0.72 | 0.58 | 0.012 | 0.048 | 2.38 | 0.62 | 0.39 | — | — | 0.030 | — | — |
| | Second outer layer | 150 | 2.86 | 0.36 | 0.50 | 0.052 | 0.008 | 0.76 | 5.32 | 0.63 | — | — | — | 0.62 | — |
| | Inner layer | 70 | 3.28 | 1.82 | 0.41 | 0.078 | 0.005 | 1.59 | 2.03 | 0.15 | 0.052 | — | — | — | — |
| 3 | First outer layer | 40 | 2.91 | 1.82 | 1.26 | 0.038 | 0.015 | 0.62 | 1.76 | 1.29 | — | — | — | — | — |
| | Second outer layer | 140 | 1.99 | 1.23 | 1.38 | 0.041 | 0.036 | 3.23 | 0.93 | 2.20 | — | 0.026 | 0.031 | — | 0.86 |
| | Inner layer | 100 | 3.68 | 2.62 | 0.86 | 0.018 | 0.010 | 0.28 | 0.31 | 0.51 | 0.048 | — | — | — | — |
| 4 | First outer layer | 60 | 3.02 | 1.30 | 0.92 | 0.078 | 0.021 | 2.55 | 0.91 | 1.38 | 0.071 | — | — | — | — |
| | Second outer layer | 140 | 2.03 | 0.51 | 0.61 | 0.032 | 0.011 | 0.72 | 0.78 | 0.73 | — | 0.042 | 0.021 | — | 0.80 |
| | Inner layer | 80 | 3.58 | 2.33 | 0.34 | 0.072 | 0.002 | 1.01 | 0.19 | 0.41 | 0.045 | — | — | — | — |
| 5 | First outer layer | 50 | 3.60 | 2.03 | 0.29 | 0.018 | 0.004 | 0.98 | 0.29 | 0.38 | 0.049 | — | — | — | — |
| | Second outer layer | 130 | 2.88 | 1.20 | 1.28 | 0.051 | 0.062 | 3.03 | 4.87 | 1.98 | — | — | — | — | — |
| | Inner layer | 100 | 1.55 | 1.88 | 0.80 | 0.026 | 0.009 | 0.88 | 0.58 | 0.62 | — | — | — | — | — |
| 6 | First outer layer | 60 | 2.96 | 1.28 | 0.92 | 0.086 | 0.020 | 2.48 | 0.90 | 1.62 | 0.048 | — | — | — | — |
| | Second outer layer | 150 | 3.10 | 0.58 | 0.52 | 0.012 | 0.042 | 3.00 | 18.36 | 1.92 | — | — | — | 0.86 | 0.62 |
| | Inner layer | 70 | 1.38 | 1.92 | 0.81 | 0.042 | 0.009 | 0.72 | 2.52 | 0.91 | — | — | 0.013 | — | — |
| 7 | First outer layer | 40 | 3.58 | 2.23 | 0.38 | 0.020 | 0.008 | 0.48 | 0.23 | 0.40 | 0.073 | — | — | — | — |
| | Second outer layer | 140 | 2.12 | 1.03 | 1.28 | 0.053 | 0.012 | 0.72 | 9.63 | 0.58 | — | 0.042 | — | — | — |
| | Inner layer | 100 | 3.52 | 2.38 | 0.39 | 0.032 | 0.004 | 0.36 | 2.01 | 0.23 | 0.052 | — | — | — | — |
| 8 | First outer layer | 70 | 2.86 | 0.78 | 1.40 | 0.081 | 0.062 | 0.49 | 0.88 | 0.40 | — | — | — | — | — |
| | Second outer layer | 140 | 3.00 | 1.33 | 1.09 | 0.049 | 0.032 | 0.69 | 17.73 | 0.68 | — | — | — | — | — |
| | Inner layer | 70 | 1.42 | 1.66 | 0.39 | 0.053 | 0.042 | 0.32 | 2.53 | 0.28 | — | — | — | — | — |
| 9 | First outer layer | 70 | 2.08 | 2.04 | 0.58 | 0.040 | 0.009 | 2.28 | 1.49 | 1.32 | — | — | 0.058 | — | — |
| | Second outer layer | 110 | 2.19 | 0.49 | 0.50 | 0.070 | 0.013 | 3.00 | 10.20 | 2.09 | — | — | 0.029 | 0.60 | — |
| | Inner layer | 100 | 3.49 | 2.79 | 0.42 | 0.053 | 0.004 | 1.02 | 2.04 | 0.58 | 0.060 | — | — | — | — |
| 10 | First outer layer | 60 | 2.38 | 0.31 | 1.08 | 0.062 | 0.013 | 0.76 | 0.92 | 0.48 | — | 0.032 | 0.028 | — | — |
| | Second outer layer | 130 | 2.73 | 0.42 | 1.23 | 0.032 | 0.041 | 3.03 | 5.03 | 2.00 | — | — | — | — | 0.68 |
| | Inner layer | 90 | 3.59 | 2.18 | 0.49 | 0.032 | 0.006 | 0.96 | 0.49 | 0.19 | 0.055 | — | — | — | — |
| 11 | First outer layer | 60 | 2.72 | 1.23 | 0.50 | 0.012 | 0.041 | 2.03 | 3.21 | 1.48 | — | — | — | 0.62 | — |
| | Second outer layer | 140 | 1.98 | 1.25 | 0.60 | 0.018 | 0.012 | 0.78 | 0.88 | 0.72 | — | — | 0.052 | — | — |
| | Inner layer | 80 | 1.53 | 1.90 | 0.38 | 0.042 | 0.036 | 0.20 | 0.28 | 0.16 | — | — | 0.013 | — | — |
| 12 | First outer layer | 70 | 2.28 | 1.23 | 1.38 | 0.068 | 0.042 | 0.38 | 3.62 | 1.58 | — | 0.016 | 0.041 | — | 0.70 |
| | Second outer layer | 130 | 3.01 | 0.41 | 1.28 | 0.012 | 0.038 | 3.08 | 19.60 | 0.60 | — | — | — | — | — |
| | Inner layer | 80 | 1.60 | 1.58 | 0.42 | 0.019 | 0.012 | 0.68 | 2.11 | 0.32 | — | — | — | — | — |
| 13 | First outer layer | 50 | 2.86 | 0.26 | 0.50 | 0.018 | 0.016 | 1.80 | 0.80 | 0.36 | — | — | — | — | — |
| | Second outer layer | 110 | 2.23 | 1.32 | 0.53 | 0.032 | 0.028 | 0.72 | 10.32 | 2.12 | — | — | 0.018 | 0.79 | — |

TABLE 1-continued

| No | | Thickness (mm) | Chemical composition (% by weight) C | Si | Mn | P | S | Ni | Cr | Mo | Mg | Al | Zr | Nb | V |
|---|---|---|---|---|---|---|---|---|---|---|---|---|---|---|---|
| | Inner layer | 120 | 3.48 | 2.32 | 0.60 | 0.078 | 0.012 | 1.02 | 1.58 | 0.58 | 0.073 | — | — | — | — |

(Balance substantially Fe and inevitable impurities)

TABLE 2

| No. | | Thickness (mm) | Chemical composition (% by weight) C | Si | Mn | P | S | Ni | Cr | Mo | Mg | Al | Zr | Nb | V |
|---|---|---|---|---|---|---|---|---|---|---|---|---|---|---|---|
| 14 | First outer layer | 50 | 2.40 | 1.20 | 0.88 | 0.061 | 0.008 | 1.20 | 0.76 | 0.58 | — | 0.018 | — | — | — |
| | Second outer layer | 130 | 2.88 | 0.49 | 0.66 | 0.005 | 0.031 | 2.46 | 13.42 | 1.02 | — | — | 0.015 | — | 0.64 |
| | Second intermediate layer | 25 | 2.22 | 0.51 | 0.40 | 0.050 | 0.021 | 0.14 | 0.20 | 0.10 | — | — | 0.021 | — | — |
| | Inner layer | 75 | 1.40 | 1.80 | 0.36 | 0.068 | 0.006 | 0.12 | 0.12 | 0.24 | — | 0.020 | — | — | — |

(Balance substantially Fe and inevitable impurities)

TABLE 3

| No. | Residual stress tangentially of following measured points ($\times 10^6$ Pa) Measured point $\phi$ 1060 mm | Measured point $\phi$ 760 mm | Measured point $\phi$ 480 mm |
|---|---|---|---|
| 3 | −51.01 | −2.94 | +61.80 |
| 5 | −31.40 | −7.85 | +84.37 |
| 7 | −35.32 | −7.85 | +57.88 |
| 9 | −51.99 | −35.32 | +62.78 |
| 11 | −47.09 | −28.45 | +94.18 |
| 13 | −22.56 | −15.70 | +71.61 |

Incidentally, for instance in Example No. 7, there is a marked difference in hardness between the spheroidal graphite cast iron for the first outer layer and the spheroidal graphite cast iron for the inner layer despite a smaller difference in composition, because the first outer layer is cooled at a fast speed by direct contact with the centrifugal casting mold, whereas the inner layer is thermally affected by the second outer layer and is therefore cooled at a slower speed.

As described above in detail, the present invention provides a sleeve for use in rolling rolls for H-section steel, etc., especially in sleeve rolls for the horizontal stands of universal mills wherein the working layer to be brought into contact with the material to be rolled and the inner layer which must be tough are made of different materials, the working layer comprising the two layers of a first outer layer of a material having high resistance to sticking and a second outer layer of a material having high wear resistance so as to possess different properties at different portions thereof as required. Accordingly the web forming portion of the sleeve is resistant to sticking, and the flange forming portions are resistant to wear, while the inner layer is adapted to exhibit high toughness. Consequently the sleeve rolls embodying the invention are usable free of sticking troubles during rolling, with greatly reduced susceptibility to local wear and without the likelihood of breaking or like accidents.

While spheroidal graphite cast steel or spheroidal graphite cast iron is used as the material for the inner layer, these materials are outstanding in break resistance. More specifically spheroidal graphite cast steel, which has high toughness, exhibits tensile strength of 588.6 to 686.7$\times 10^6$ Pa and an elongation of 1.0 to 4.0%. On the other hand, spheroidal graphite cast iron, which is slightly lower than the cast steel in toughness, exhbits tensile strength of 490.5 to 588.6$\times 10^6$ Pa and as elongation of 0.5 to 2.0% but has the advantage that it can be easily relieved of residual stress at low temperatures. When the cast iron is prepared by the usual process, the residual stress thereof (tensile residual stress tangentially of shrinkage fit surface) is about 60% of that of spheroidal graphite cast steel.

The scope of the present invention is not limited to the above description, but various modifications will be readily made by one skilled in the art without departing from the spirit of the invention. Accordingly such modifications are included within the scope of the invention.

What is claimed is:

1. A composite sleeve for use in a hot-rolling roll for H-section and channel steel comprising an outer working layer and an inner layer intended to be out of contact with said steel to be hot-rolled, said outer-working layer comprising in turn a first outer layer covering and fused to a second outer layer which in turn covers and is fused to said inner layer, said first outer layer being comprised of a material selected from the group consisting of adamite with graphite, spheroidal graphite cast iron, adamite and mixtures thereof, wherein said adamite with graphite is comprised of C in 2.0–3.2% by weight, Si in 0.6–2.5% by weight, Mn in 0.4–1.5% by weight, Ni between 0 and up to 2.5% by weight, Cr in 0.5–2.0% by weight, Mo in 0.2–2.0% by weight, up to 0.1% P and up to 0.1% S by weight, wherein Cr is present in amounts less than 1.5 the amount of Si present, the balance being substantially Fe; wherein said spheroidal graphite cast iron is comprised of C in 2.8–3.8% by weight, Si in 1.2–3.0% by weight, Mn in 0.2–1.0% by weight, between 0 and up to 3.0% by weight Ni, Cr in 0.1–1.0% by weight, Mo in 0.2–2.0% by weight, Mg in 0.02–0.1% by weight, up to 0.1% P and up to 0.04% S by weight, balance being substantially Fe, and wherein said adamite comprises C in 2.2–3.0% by weight, Si 0.2–1.5% by weight, Mn in 0.4–1.5% by weight, between 0 and up to 2.5% Ni, Cr in 0.5–4.0% by weight where Cr is present in amounts at least as much as 1.5 times the amount of Si, Mo in 0.2–2.0% by weight, up to 0.1% P and up to 0.1% S by weight, the balance being substantially Fe;

said second outer layer comprising a material selected from the group consisting of adamite, high chromium iron and mixtures thereof, wherein said adamite is comprised of C in 1.8–3.0% by weight, Si in 0.2–1.5% by weight, Mn in 0.4–1.5% by weight, Ni in 0.5–3.5% by weight, Cr in 0.5–6.0% by weight, Mo in 0.5–2.5% by weight, up to 0.1% P and up to 0.1% S by weight, the balance being substantially Fe and wherein said high chromium iron comprises C in 2.0–3.2% by weight, Si in 0.3–1.5% by weight, Mn in 0.4–1.5% by weight, Ni in 0.5–3.5% by weight, Cr in 8.0–25.0% by weight, Mo in 0.5–2.5% by weight, up to 0.1% P and up to 0.1% S by weight, the balance being substantially Fe;

said inner layer being comprised of a material selected from the group consisting of spheroidal graphite cast steel, spheroidal graphite cast iron and mixtures thereof, wherein said spheroidal graphite cast steel comprises C in 1.0–2.0% by weight, Si in 0.6–3.0% by weight, Mn in 0.2–1.0% by weight, Ni in 0.1–2.0% by weight, Cr in 0.1–3.0% by weight, Mo in 0.1–1.0% by weight, up to 0.1% by weight P and up to 0.1% by weight S by weight, balance being substantially Fe, and said spheroidal graphite cast iron comprises C in 2.8–3.8% by weight, Si in 1.5–3.2% by weight, Mn in 0.3–1.0% by weight, between 0 and up to 2.0% by weight Ni, between 0 and up to 3.0% by weight Cr, between 0 and up to 0.6% by weight Mo, Mg in 0.02–0.1% by weight, up to 0.1% by weight P and up to 0.03% by weight S, balance being substantially Fe.

2. A sleeve as defined in claim 1 wherein the adamite with graphite for forming the first outer layer further contains one or at least two of Ti, Al and Zr in a total amount of up to 0.1% by weight.

3. A sleeve as defined in claim 1 wherein the spheroidal graphite cast iron for forming the first outer layer further contains rare earth elements in a total amount of up to 0.05% by weight.

4. A sleeve as defined in claim 1 wherein the adamite for forming the first outer layer further contains one or at least two of Ti, Al and Zr in a total amount of up to 0.1% by weight.

5. A sleeve as defined in claim 1 or 4 wherein the adamite for forming the first outer layer further contains one or both of Nb and V in amounts of $0<Nb\leqq 1.0\%$ by weight and $0<V\leqq 1.0\%$ by weight.

6. A sleeve as defined in claim 1 wherein the adamite for forming the second outer layer further contains one or at least two of Ti, Al and Zr in a total amount of up to 0.1% by weight.

7. A sleeve as defined in claim 1 or 6 wherein the adamite for forming the second outer layer further contains one or both of Nb and V in amounts of $0<Nb\leqq 1.0\%$ by weight and $0<V\leqq 1.0\%$ by weight.

8. A sleeve as defined in claim 1 wherein the high chromium iron for forming the second outer layer further contains one or at least two of Ti, Al and Zr in a total amount of up to 0.1% by weight.

9. A sleeve as defined in claim 1 or 8 wherein the high chromium iron for forming the second outer layer further contains one or both of Nb and V in amounts of $0<Nb\leqq 1.0\%$ by weight and $0<V\leqq 1.0\%$ by weight.

10. A sleeve as defined in claim 1 wherein the spheroidal graphite cast steel for forming the inner layer further contains one or at least two of Ti, Al and Zr in a total amount of up to 0.1% by weight.

11. A sleeve as defined in claim 1 wherein the spheroidal graphite cast iron for forming the inner layer further contains rare earth elements in a total amount of up to 0.05% by weight.

12. A sleeve as defined in claim 1 wherein a first intermediate layer is further interposed between the first outer layer and the second outer layer, the first outer layer covering and being fused to the first intermediate layer, the first intermediate layer covering and being fused to the second outer layer, and the second outer layer covering and being fused to the inner layer.

13. A sleeve as defined in claim 1 wherein a second intermediate layer is further interposed between the second outer layer and the inner layer, the first outer layer covering and being fused to the second outer layer, the second outer layer covering and being fused to the second intermediate layer, and the second intermediate layer covering and being fused to the inner layer.

14. A sleeve as defined in claim 1 wherein a first and a second intermediate layers are further interposed between the first outer layer and the second outer layer and between the second outer layer and the inner layer individually, the first outer layer covering and being fused to the first intermediate layer, the first intermediate layer covering and being fused to the second outer layer, the second outer layer covering and being fused to the second intermediate layer, and the second intermediate layer covering and being fused to the inner layer.

* * * * *